US011122844B1

(12) United States Patent
Coban et al.

(10) Patent No.: US 11,122,844 B1
(45) Date of Patent: Sep. 21, 2021

(54) METHOD OF DONNING A MAGNETICALLY-FASTENED UPPER GARMENT

(71) Applicants: John E. Coban, Boca Raton, FL (US); John E. Coban, II, Boca Raton, FL (US); Mary A. Coban, Boca Raton, FL (US)

(72) Inventors: John E. Coban, Boca Raton, FL (US); John E. Coban, II, Boca Raton, FL (US); Mary A. Coban, Boca Raton, FL (US)

( * ) Notice: Subject to any disclaimer, the term of this patent is extended or adjusted under 35 U.S.C. 154(b) by 0 days.

(21) Appl. No.: 16/262,410

(22) Filed: Jan. 30, 2019

Related U.S. Application Data

(63) Continuation of application No. 14/991,058, filed on Jan. 8, 2016, now abandoned.

(60) Provisional application No. 62/147,922, filed on Apr. 15, 2015.

(51) Int. Cl.
*A41D 13/12* (2006.01)

(52) U.S. Cl.
CPC ..... *A41D 13/129* (2013.01); *A41D 13/1236* (2013.01); *A41D 13/1245* (2013.01)

(58) Field of Classification Search
CPC ..... A41D 13/129; A41D 13/1236; A41D 13/1245; A41B 1/08; A41B 9/06
USPC ..... 2/114, 69; 24/303
See application file for complete search history.

(56) References Cited

U.S. PATENT DOCUMENTS

| | | | | |
|---|---|---|---|---|
| 5,564,123 | A * | 10/1996 | Grassick | A41D 13/1245 2/114 |
| 6,216,271 | B1 * | 4/2001 | Chen | A41D 13/1245 2/114 |
| 6,378,174 | B1 * | 4/2002 | Wong | A41F 1/002 24/303 |
| 9,655,385 | B2 * | 5/2017 | Marino | A41B 1/08 |
| 10,433,600 | B2 * | 10/2019 | Emoff | A41F 1/002 |
| 2012/0246796 | A1 * | 10/2012 | Dunn | A41D 13/129 2/114 |
| 2014/0143985 | A1 * | 5/2014 | Horton | A41B 1/10 24/303 |
| 2015/0033439 | A1 * | 2/2015 | Dimotsantos | A41D 13/1236 2/114 |
| 2015/0059048 | A1 * | 3/2015 | Stanley | A41D 13/129 2/69 |
| 2016/0128391 | A1 * | 5/2016 | Moore | A41D 13/1245 2/128 |

FOREIGN PATENT DOCUMENTS

WO WO-2014160916 A2 * 10/2014 ..... A45C 13/1069

* cited by examiner

*Primary Examiner* — Katherine M Moran
(74) *Attorney, Agent, or Firm* — John Rizvi; John Rizvi, P.A.—The Patent Professor®

(57) ABSTRACT

A method of donning a magnetically-fastened upper garment is disclosed. The method and garment are configured for being carried out and worn, respectively, by a post-operative physically challenged individual using one arm only. The upper garment is configured for easy donning and removal without requiring another person's assistance, thus promoting independence of the individual. The upper garment has a front which is vertically separated from the rear at one side of the garment. A plurality of front and rear magnets are embedded in corresponding locations in the free edges along the vertical separation to effect closure of the garment and retention of the garment on the user.

19 Claims, 9 Drawing Sheets

METHOD OF DONNING A MAGNETICALLY-FASTENED UPPER GARMENT

CROSS-REFERENCE TO RELATED APPLICATION

This application is a Continuation of U.S. patent application Ser. No. 14/991,058, filed on Jan. 8, 2016, which in turn claims the benefit of U.S. Provisional Patent Application Ser. No. 62/147,922, filed on Apr. 15, 2015, which is incorporated herein in its entirety

FIELD OF THE INVENTION

The present disclosure generally relates to an upper torso garment configured for easy fastening. More particularly, the present disclosure relates to a method of donning an upper torso garment with open seams on one side thereof and including magnets along the open seams for easy closure and removal.

BACKGROUND OF THE INVENTION

Many people suffer from physical challenges to their upper body. For instance, patients recovering from arm or shoulder surgery may suffer from temporary arm mobility restrictions. In addition, permanent conditions such as birth defects, accident injuries, and veterans dealing with war injuries can result in individuals with arm deformities, missing arms, or permanent arm movement impairment. Consequently, many daily activities that individuals take for granted become major challenges for these individuals.

One such activity is getting dressed every morning. Garments such as shirts for covering a person's upper torso are typically designed for individuals having full use of two arms and hands. Fitting a shirt onto a person's body normally requires moving and operating with both arms. Inserting buttons in button holes requires nimble fingers from both hands, although with practice, an individual can manipulate buttons into button holes with the use of fingers from only one hand. Mechanical snap fasteners are easier to manipulate than buttons, but also require the individual elements of the snap fasteners be compressed together to effectuate engagement and thus present a different set of challenges for an individual with physical limitations.

While in days past, society in general did not make special effort to accommodate such individual, today's society has recognized the need to eliminate obstacles to those who are physically handicapped. Laws have been passed and enforced to require businesses and areas of public access to provide accommodations for the physically challenged to allow those individuals to experience to the maximum extent possible a barrier free life. However, clothing has not been the subject of such mandates, and most clothing continues to cater strictly to individual who are multi-dexterous and able to maneuver buttons through buttonholes or press snap fastener elements together. Often, a physically challenged individual can live each day with minimal obstacles, yet may require the assistance of an aide to assist in getting dressed and undressed because of difficulty with standard clothing designs.

Therefore, there remains a need for clothing solutions that can readily and easily be donned and removed by individuals who lack the dexterity for manipulating standard clothing.

SUMMARY OF THE INVENTION

The present disclosure is generally directed to a method of donning an upper garment assembly for wearing by a post-operative or physically challenged individual. The method is carried out using one arm only. The upper garment assembly is configured for easy donning and removal without requiring another person's assistance, thus promoting independence of the individual. The upper garment includes a front panel configured to at least partially cover the front side of a torso of a human body and has a top portion defining a front shoulder edge, a front neck edge, and a front side edge. A rear panel is configured to at least partially cover the torso of the human body and has a top portion defining a rear shoulder edge, a rear neck edge, and a rear side edge. The rear panel is preferably permanently affixed to the front panel at a first lateral side of the torso. A plurality of front magnetic fasteners is affixed to the front panel in the front shoulder edge and the front side edge. A plurality of rear magnetic fasteners is affixed to the rear panel in the rear shoulder edge and the rear side edge. Each rear magnetic fastener is in registration with a corresponding front magnetic fastener and is configured to magnetically attract to the corresponding front magnetic fastener. In some embodiments, the upper garment assembly can be interchangeably worn in the event of a mobility restriction on either one of the right arm and the left arm, by reversing the upper garment back-to-front or inside-out.

In a second aspect, the front panel and said rear panel can be unitary one with the other from a single piece of cloth, such as by permanent stitching or material continuity. The garment assembly is thus firmly constructed as one piece, and closeable at the second side thereof by the magnetic fasteners, greatly facilitating donning of the garment assembly by the impaired person.

In another aspect, the plurality of front magnetic fasteners can be magnets and said rear magnetic fasteners can be ferromagnetic. Alternatively, the plurality of front magnetic fasteners can be ferromagnetic and the rear magnetic fasteners can be magnets. Further alternatively, the plurality of front magnetic fasteners can be magnets and the rear magnetic fasteners can be magnets, each front magnetic fastener configured to attract to a corresponding rear magnetic fastener.

In yet another aspect, the garment assembly can further include a first sleeve formed at an upper portion of the front and the rear panels at the first lateral side of the garment assembly; a front second sleeve portion extending from the top portion of the front panel, the front second sleeve portion defining a front second sleeve outer edge and a front second sleeve inner edge; and a rear second sleeve portion extending from the top portion of the rear panel, the rear second sleeve portion defining a rear second sleeve outer edge and a rear second sleeve inner edge. The first sleeve and/or the second sleeve can be a short sleeve or a long sleeve. Alternatively, the garment assembly can be sleeveless on one or both sides thereof.

In another aspect, the front second sleeve outer edge can include at least one additional front magnetic fastener and the rear second sleeve outer edge can include at least one additional rear magnetic fastener configured to be magnetically attracted to the corresponding at least one additional front magnetic fastener. Preferably, the front second sleeve inner edge and the rear second sleeve inner edge are devoid of magnetic fasteners. Additionally or alternatively, an underarm area of the second sleeve is preferably devoid of magnetic fasteners.

In yet another aspect, a magnetic attraction of the front magnetic fasteners to the rear magnetic fasteners is of a strength to cause opposing lateral edges of the front panel and the rear panel to pull one to the other when positioned within two inches one from the other.

These and other features, aspects, and advantages of the invention will be further understood and appreciated by those skilled in the art by reference to the following written specification, claims and appended drawings.

BRIEF DESCRIPTION OF THE DRAWINGS

The invention will now be described, by way of example, with reference to the accompanying drawings, where like numerals denote like elements and in which.

Like reference numerals refer to like parts throughout the various views of the drawings.

DETAILED DESCRIPTION OF THE INVENTION

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure, which is defined by the claims. For purposes of description herein, the terms "upper", "lower", "left", "rear", "right", "front", "vertical", "horizontal", and derivatives thereof shall relate to the invention as oriented in FIG. 1. Furthermore, there is no intention to be bound by any expressed or implied theory presented in the preceding technical field, background, brief summary or the following detailed description. It is also to be understood that the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

Figure 1:
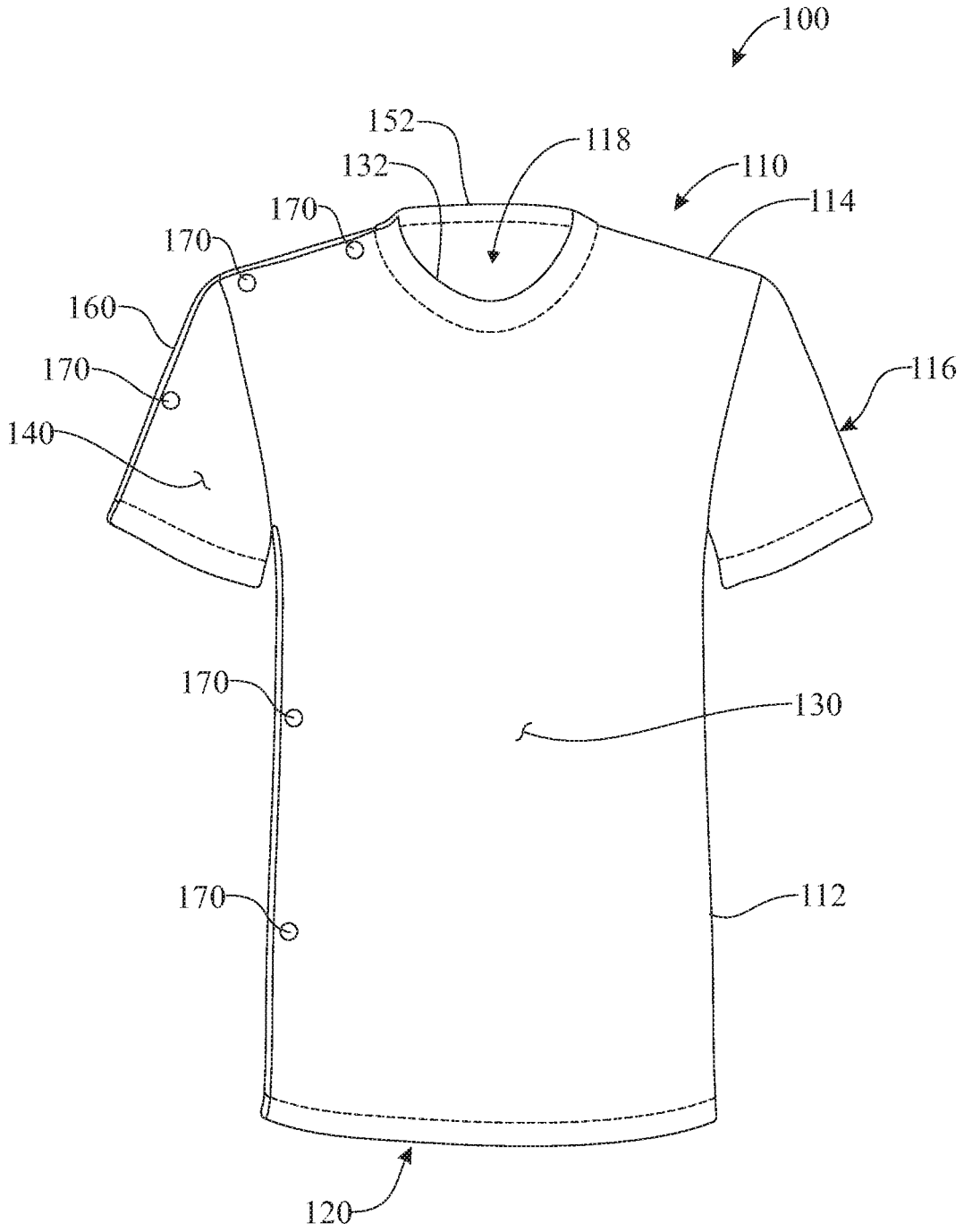
FIG. 1 presents a front view of a garment assembly in one exemplary embodiment of the invention, wherein the garment assembly is shown in a first, closed position.
Figure 2:
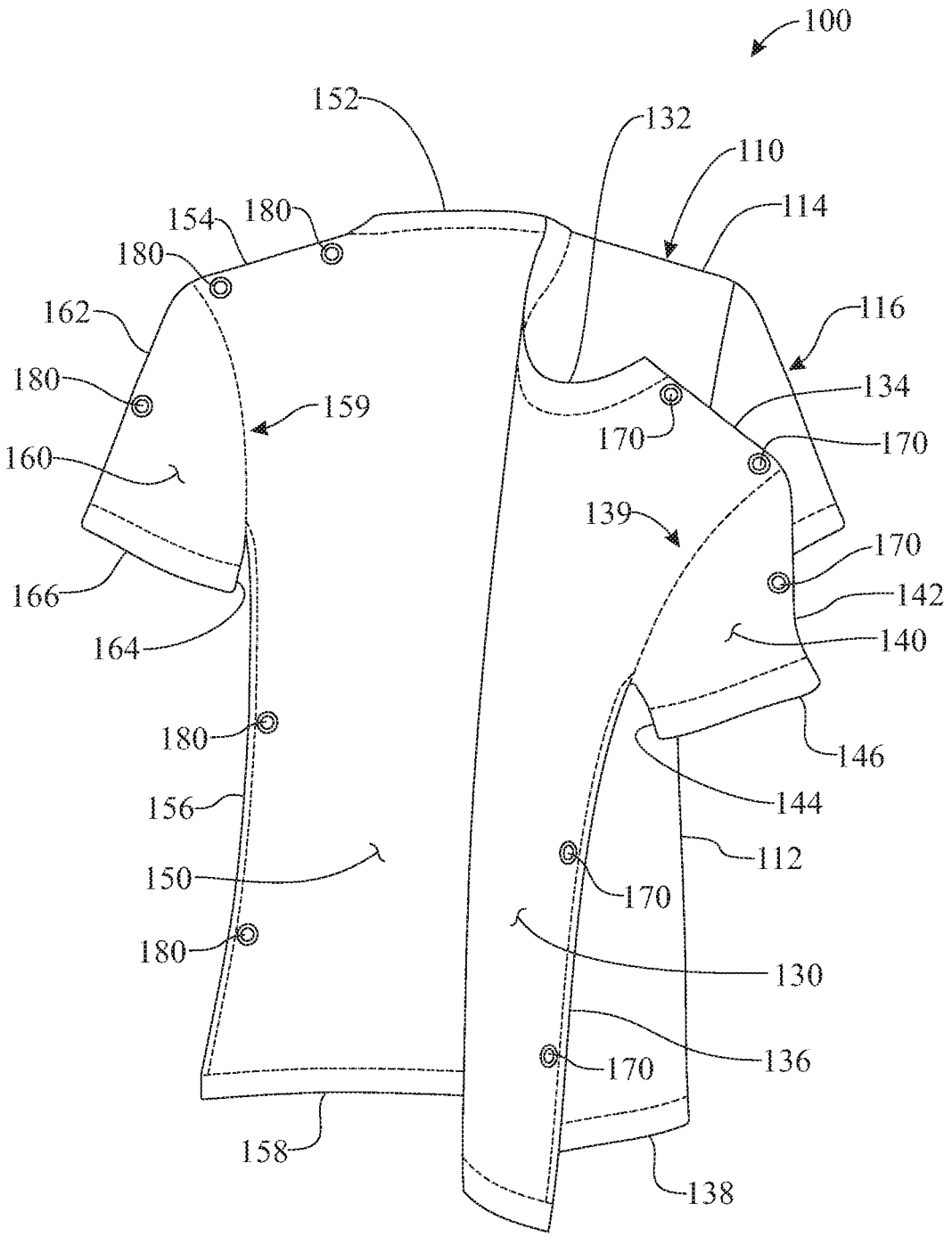
FIG. 2 presents a front view of the garment assembly of FIG. 1, arranged in a second, open position.
Figure 3:
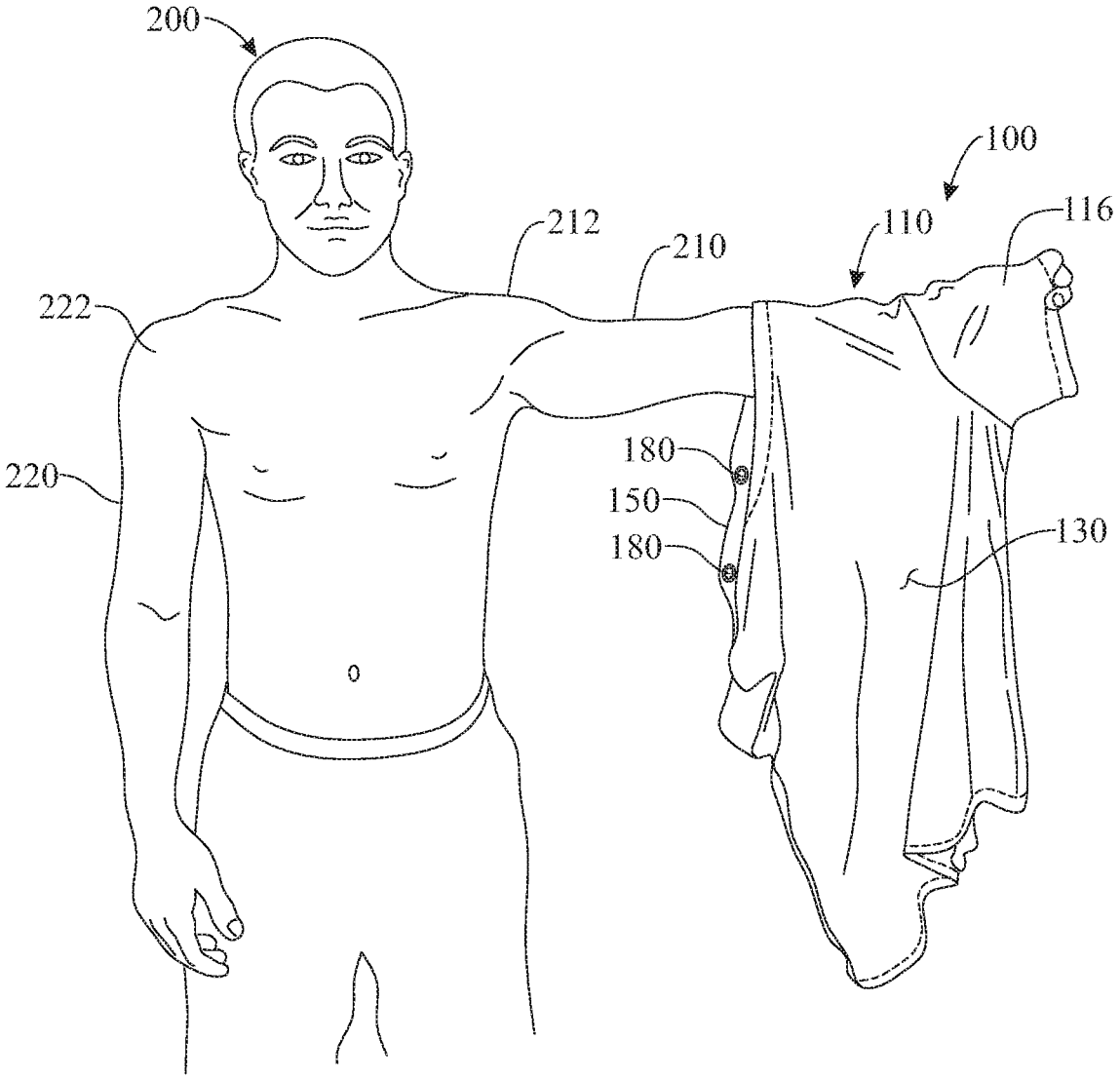
FIG. 3 presents a front view of a user in the process of donning the garment assembly, and more particularly, performing a first step of an exemplary fitting sequence by inserting a mobile arm through a sleeve on a permanently-closed, sewn or knitted side of the garment assembly.

In one exemplary implementation of the invention, an upper garment assembly 100 for wearing by a physically challenged individual is shown in FIGS. 1 and 2 illustrating its various components, wherein the upper garment assembly 100 is configured for easy donning and removal. Specifically, the upper garment assembly 100 is configured for donning and removal by an individual who only has the use of one arm and hand, and minimal or no use of an opposite arm and hand. While the various FIGS. 1 through 8 are directed to an upper garment assembly 100 for use by a physically challenged individual who has a usable left arm and an immobile right arm, those practiced in the art will readily recognize that an upper garment which is the mirror image of upper garment assembly 100 can be utilized for a physically challenged individual who has a usable right arm and an immobile left arm.

As illustrated in FIGS. 1 and 2, the upper garment assembly 100 includes a garment body having a front panel 130 and a rear panel 150. Each of the front and rear panels 130, 150 are cut to cover the front torso and rear torso respectively of a human body. The front panel 130 is joined to the rear panel 150 along a side seam 112 at a first side of the garment body 110 and along a shoulder seam 114 on the same first side of the garment body 110. Any one of the side seam 112 and the shoulder seam 114 may be replaced, in alternative embodiments, with more than one seam or permanent sticking of fabric materials. In some embodiments, the front panel 130 and rear panel 150 may be unitary one with the other from the same piece of cloth wherein one or both of the seams 112, 114 may be eliminated. A first sleeve 116 is formed at an upper portion of the front and rear panels 130, 150 for enclosing thereabout the user's usable arm. Those practiced in the art will readily recognize that while FIGS. 1 through 8 illustrate a short-sleeved garment that the upper garment assembly 100 may also incorporate long sleeves or no sleeves without deviating from the intent of this disclosure.

As best visualized in FIG. 2, the front panel 130 defines a front neck edge 132, a front shoulder edge 134, a front side edge 136 and a front bottom edge 138. The front side edge 136 extends upwardly from the front bottom edge 138. Further, a front second sleeve portion 140 is attached to a top portion 139 of the front panel 130 laterally opposite from the side seam 112, and on a second side of the garment body 110 opposite the first side. The front second sleeve portion 140 also defines a front second sleeve outer edge 142, a front second sleeve inner edge 144 and a front second sleeve distal edge 146. The front second sleeve outer edge 142 extends from the front shoulder edge 134. In turn, the front second sleeve inner edge 144 extends from the front side edge 136.

Similarly, the rear panel 150 defines a rear neck edge 152, a rear shoulder edge 154, a rear side edge 156 and a rear bottom edge 158. The rear side edge 156 extends upwardly from the rear bottom edge 158. Further, a rear second sleeve portion 160 is attached to a top portion 159 of the rear panel 150 laterally opposite from the side seam 112 and on the second side of the garment body 110. The rear second sleeve portion 160 also defines a rear second sleeve outer edge 162, a rear second sleeve inner edge 164 and a rear second sleeve distal edge 166. The rear second sleeve outer edge 162 extends from the rear shoulder edge 154. In turn, the rear second sleeve inner edge 164 extends from the rear side edge 156.

As best shown in FIG. 1, in combination, the front neck edge 132 and rear neck edge 152 of the front and rear panels 130, 150 combine to form a neck opening 118 in the garment body 110 of the upper garment assembly 100 to encircle a user's neck. In turn, the front bottom edge 138 and the rear bottom edge 158 combine to resemble a bottom opening 120 to encircle a user's waist, hips or torso.

In accordance with the invention, as best shown in FIG. 2, a plurality of first magnetic fasteners is affixed to the front panel 130 and a plurality of second magnetic fasteners is affixed to the rear panel 150, the first and second magnetic fasteners being configured to magnetically attract. More specifically, at least one first magnetic fastener can be arranged at or near the front shoulder edge 134, the front second sleeve outer edge 142, the front second sleeve inner edge 144, and/or the front side edge 136 of the front panel 130, and at least one second magnetic fastener can be arranged at or near the rear shoulder edge 154, the rear second sleeve outer edge 162, the rear second sleeve inner edge 164, and/or the rear side edge 156 of the rear panel 150.

A first fastener on the front panel 130 or the rear panel 150 can be a magnet having a first polarity, and a second fastener on the other of the rear panel 150 and the front panel 130 can be a mating magnet having an opposite polarity. In another example, a first fastener on the front panel 130 or the rear panel 150 can be a magnet, and a second fastener on the other of the rear panel 150 and the front panel 130 can be a mating ferromagnetic piece that is attracted to the magnet.

For instance, the present embodiment comprises a plurality of front magnets 170 embedded at spaced apart intervals in the front shoulder edge 134, the front second sleeve outer edge 142, and the front side edge 136 of the front panel 130. Most preferably, the front magnets 170 are embedded within a hem to remain substantially unseen from an exterior of the upper garment assembly 100. Additionally, a plurality of compatible rear magnets 180 are embedded at spaced apart intervals in the rear shoulder edge 154, the rear second sleeve edge 162, and the rear side edge 156 of the rear panel 150. The spaced apart intervals of the rear magnets 180 correspond to the placement of the spaced apart front magnets 170 to facilitate the proper alignment of the front and rear shoulder edges 134, 154, the front and rear second sleeve outer edges 142, 162, and the front and rear side edges 136, 156. Further, the front magnets 170 and rear magnets 180 are magnetically attracted to each other when the front shoulder edge 134, the front second sleeve outer edge 142, and the front side edge 136 overlap in closing fashion the rear shoulder edge 154, the rear second sleeve edge 162, and the rear side edge 156. Preferably, the magnets 170, 180 when attracted one to the other have a pull force sufficiently strong to pull opposing edges one to the other when separated within 2 inches (5.08 cm). In this manner, the user will not have to exert an excessive force to attach a front side of the garment body 110 to a rear side of the garment body 110. Instead, the user will simply need to bring the front panel 130 somewhat close to the rear panel 150, and the magnets 170, 180 will automatically finish pulling both panels 130, 150 towards one another and become attached to one another by their magnetic attraction forces, securing the panels 130, 150 to each other. In addition, since the magnets are attracted from a certain distance and pulled towards one another by magnetic forces, in contacting one another the magnets 170, 180 provide an audible "snap" sound that indicates the user that the panels 130, 150 have become affixed. One of ordinary skill in the art may understand that the magnets may contact one another directly or indirectly in dependence of the specific construction of the garment body 110, as the magnets may or may not be provided with coverings or be embedded in fabric; these various constructions will not be described in detail so as not to obscure the invention. The automatic attraction, pulling and fastening of the magnetic second side of the garment body 110, together with the "snapping" audible confirmation provided by the magnets contacting one another, greatly facilitates donning of the garment by a person having restricted mobility of an arm on said second side (a right arm, according to the position depicted in the drawings), as will be explained in greater detail hereinafter.

As illustrated in FIGS. 1 and 2, the garment body 110 of the present embodiment is short-sleeved. However, magnets 170, 180 can be utilized when a long-sleeved upper garment is constructed in the manner disclosed herein to aid in fastening a front sleeve portion to a rear sleeve portion.

As shown, the garment body 110 can be devoid of magnets in the underarm area, i.e., at the intersection of the rear side edge 156 and rear second sleeve inner edge 164, and at the intersection of the front side edge 136 and the front second sleeve inner edge 144, in order to minimize inward pulling of the arm by the garment body 110. This may render the garment assembly 100 more comfortable when wearing a sling over the garment. Further, the absence of magnets in the underarm area also facilitates donning and removing the upper garment assembly 100, as will be explained in greater detail hereinafter.

Also in the present embodiment, the garment body 110 can be devoid of magnets on the entire length of the front second sleeve inner edge 144 and the rear second sleeve inner edge 164 of the second front and rear second sleeve portions 140, 160. The second sleeve is thus formed by the attachment of the front and rear magnet(s) on the front second sleeve outer edge 142 and rear second sleeve outer edge 162. Such configuration greatly facilitates donning and removing the garment, while providing a visual effect of a conventional sleeve and not inhibiting the wearing of a sling.

Figure 4:
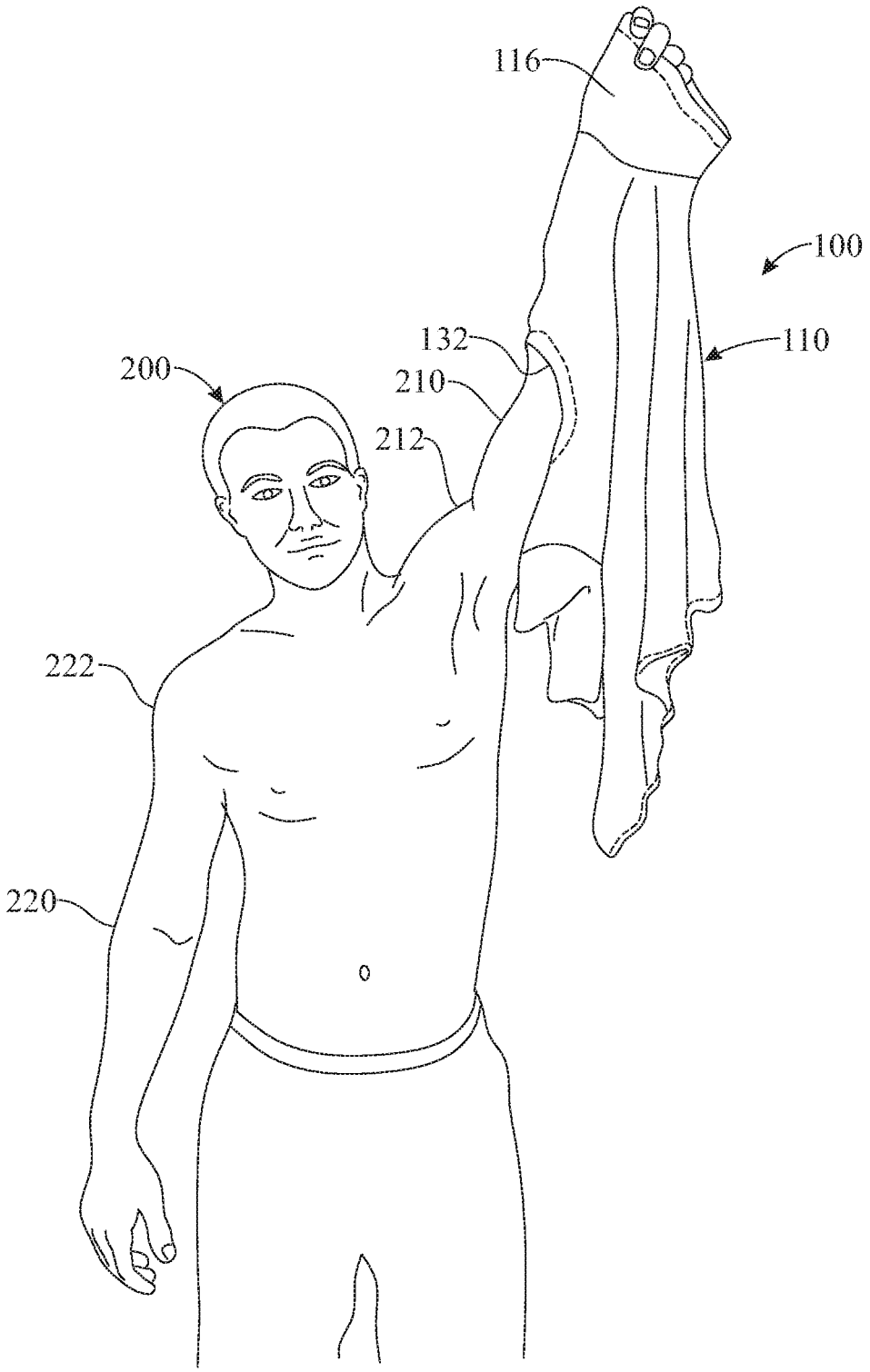
FIG. 4 presents a front view of the user performing a second step of the exemplary fitting sequence, wherein the user raises the mobile arm and allows the garment assembly to slide down the arm.

As illustrated in FIGS. 3 through 8, a method for donning the upper garment assembly 100 disclosed above is illustrated sequentially. As shown in the sequential FIGS. 3 through 8, a user 200 has a usable first (left) arm 210 and a first shoulder 212 here represented as on the user's left side. The user 200 also has an immobile second (right) arm 220 and a second shoulder 222. The user wishes to put on the upper garment assembly 100 described above and is able to only use his first arm 210. To begin the process of donning the upper garment assembly 100, the user 200 inserts his usable first arm 210 between the front panel 130 and the rear panel 150 and through the first sleeve 116 while holding his usable first arm 210 out in for instance a generally horizontal position. While grasping the first sleeve 116, the user 200 raises his usable first arm 210 as shown in FIG. 4, releases the first sleeve 116 and thus allows the first sleeve 116 of the garment body 110 to slide down his usable first arm 210.

Figure 5:
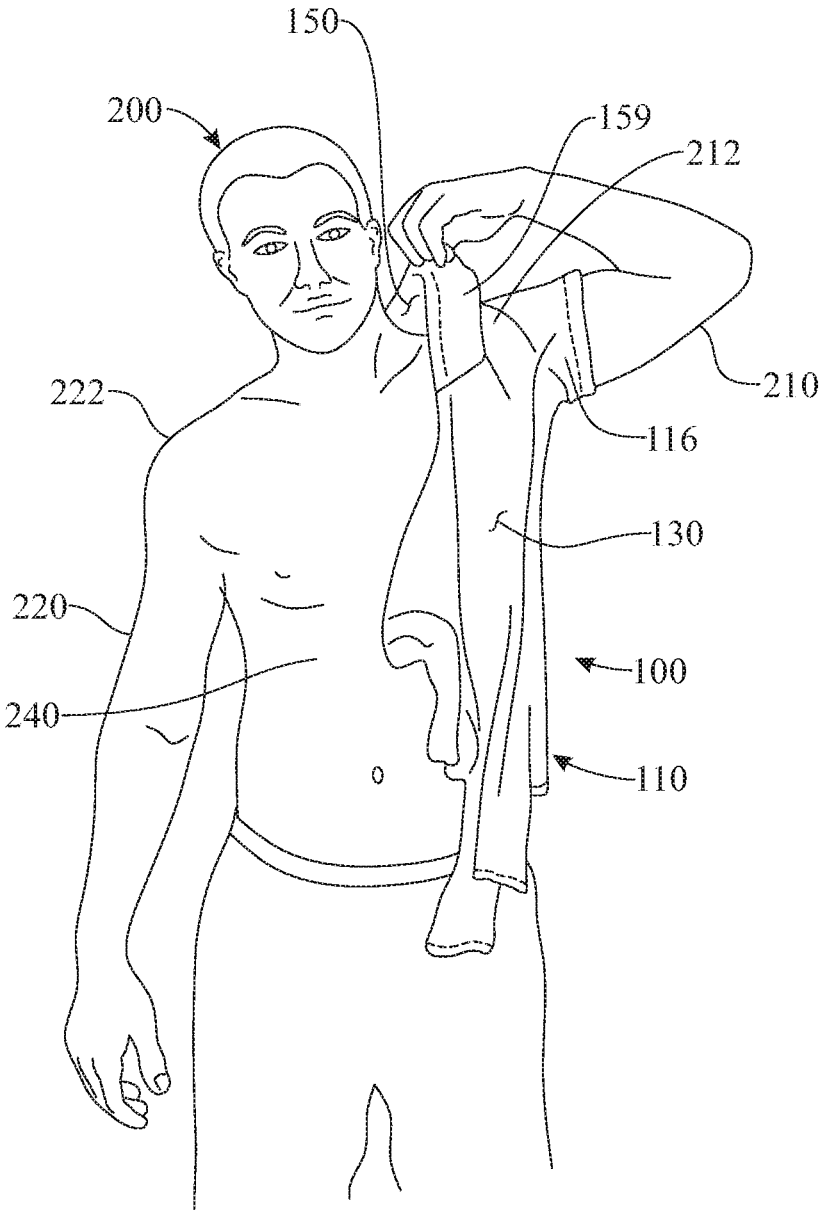
FIG. 5 presents a front view of the user performing a third step of the exemplary fitting sequence, wherein the user grasps a rear upper part of the garment assembly with his mobile arm to bring the upper part of the garment assembly towards and over the user's right shoulder.
Figure 6:
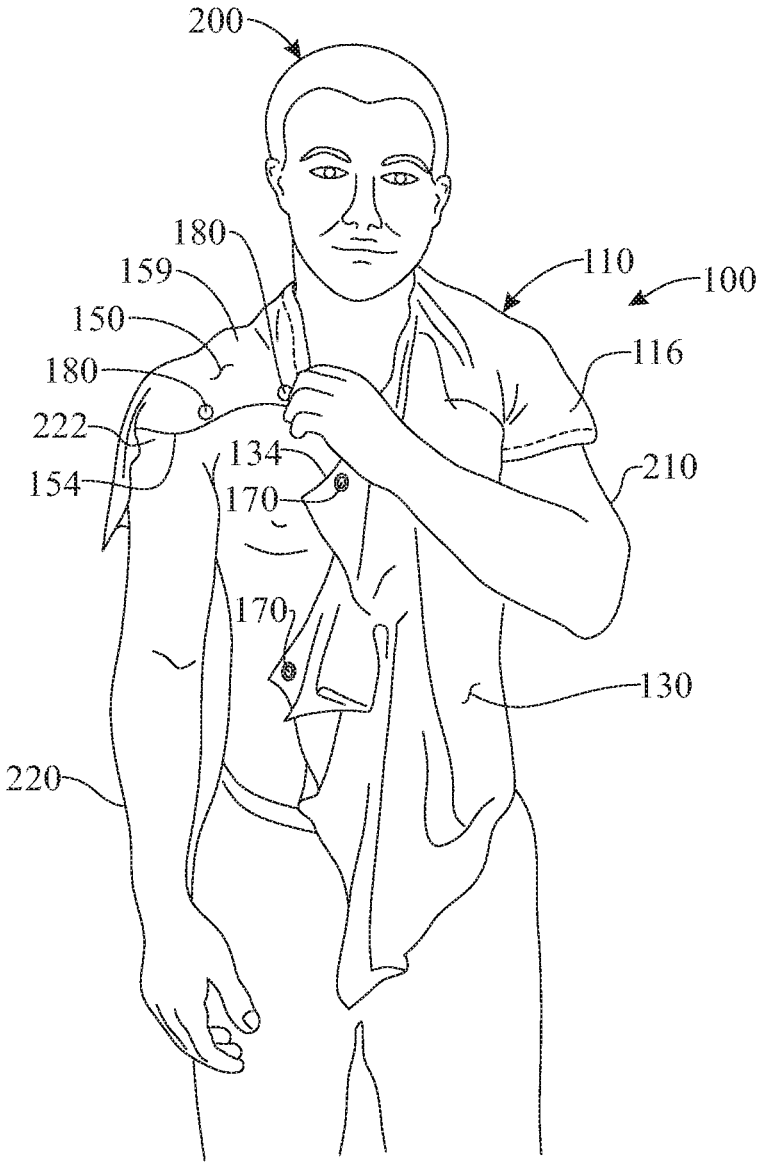
FIG. 6 presents a front view of the user performing a fourth step of the exemplary fitting sequence, wherein the user secures the upper rear part of the garment assembly on the user's right shoulder.

As illustrated in FIG. 5, the user 200 then adjusts the garment body 110 to properly sit on his first shoulder 212 in the upper portion of his usable first arm 210. The user 200 grasps the top portion 159 of the rear panel 150 and brings it over his second shoulder 222 as depicted in FIG. 6. The user 200 secures the top portion 159 of the rear panel over his second shoulder 222 in FIG. 6.

Figure 7:
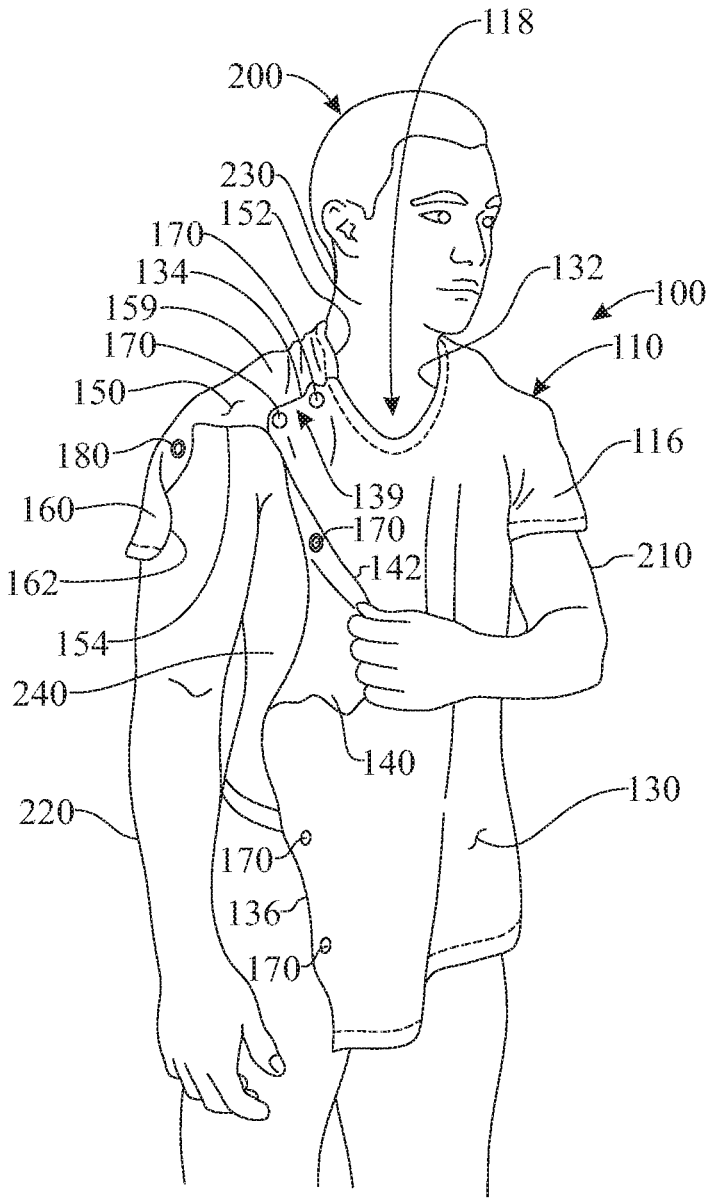
FIG. 7 presents a front view of the user performing a fifth step of the exemplary fitting sequence, wherein the user has maneuvered the upper front part of the garment assembly near to the upper rear part of the garment assembly and allowing the respective magnetic fasteners to attach to one another.

As shown in FIG. 7 the user 200 then maneuvers the top portion 139 of the front panel 130 toward the top portion 159 of the rear panel 150. When the front magnets 170 at or near the front shoulder edge 134 and the rear magnets 180 at or near the rear shoulder edge 154 are about 2 or less than 2 inches (5.08 cm) apart, responding to their mutual attraction one to the other, the front and rear magnets 170, 180 pull the front and rear shoulder edges 134 and 154 of the front and rear panels 130 and 150 together, thus assisting the user in bringing the front panel 130 towards the rear panel 150. Eventually, the front and rear magnets 170, 180 attach to one another to secure the front shoulder edge 134 to the rear shoulder edge 154. The front neck edge 132 and rear neck edge 152 encircle the user's neck 230, thereby forming the neck opening 118.

Figure 8:
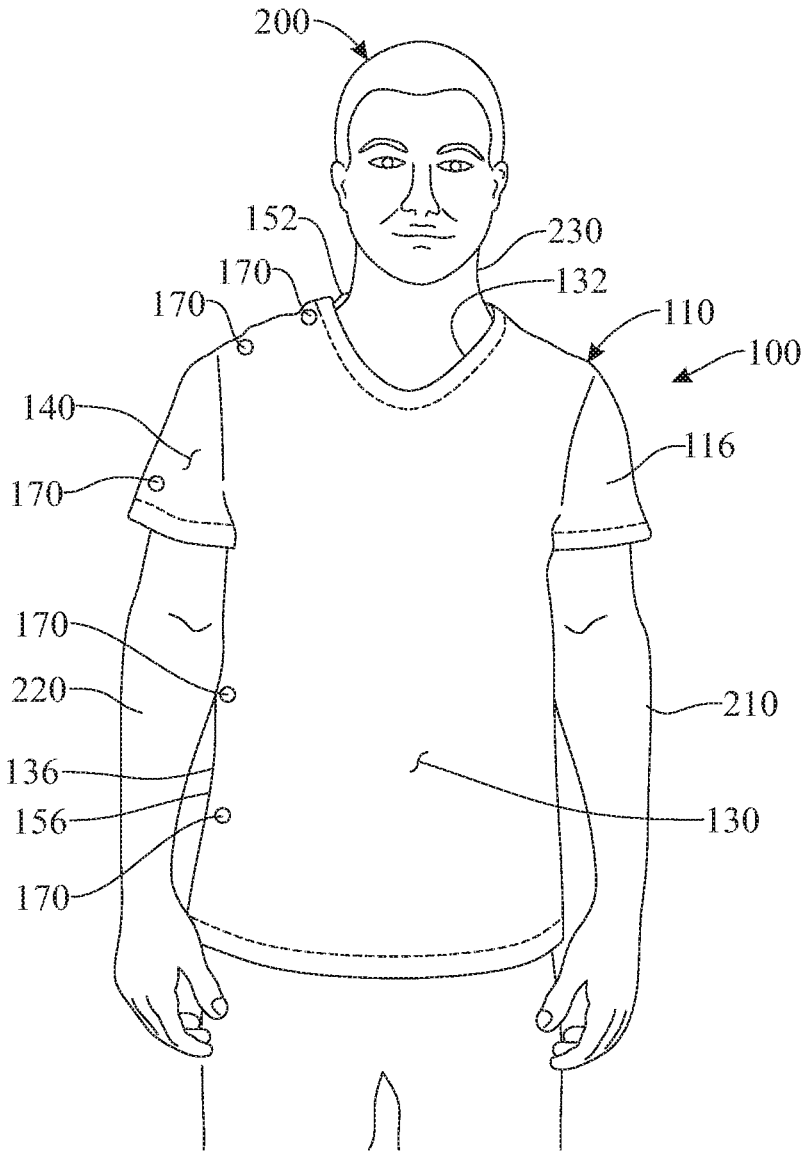
FIG. 8 presents a front view of the user with the garment assembly in a final donned configuration wherein the respective side and sleeve magnetic fasteners have attached to one another.

In like manner, the user 200 utilizes his usable first arm 210 to maneuver the front second sleeve outer edge 142 proximate to the rear second sleeve outer edge 162 thereby permitting the front and rear magnets 170, 180 thereon to pull the front second sleeve outer edge 142 and the rear second sleeve outer edge 162 towards one another, and to couple and secure the front second sleeve outer edge 142 to the rear second sleeve outer edge 162. Finally, the user 200 maneuvers the front side edge 136 of the front panel 130 toward the rear side edge 156 of the rear panel 150. Again, when the respective front magnets 170 and rear magnets 180 are sufficiently proximate one to the other, the magnets 170, 180 pull the front side edge 136 and the rear side edge 156 towards one another, and eventually contact one another providing a "snapping" sound. Once the magnets 170, 180 have contacted one another, their magnetic attraction secures the front side edge 136 to the rear side edge 156 thereby completing the donning of the upper garment assembly 100 around the user's torso 240. As shown in FIG. 8, the garment assembly 100 in its final, donned situation resembles a conventional short-sleeved T-shirt fitted onto a user's body; however, by means of the new and unique features explained heretofore, the user 200 has been able to apply the shirt using only one arm (first arm 210), i.e., despite not being able to move the other arm (second arm 220).

Figure 9:
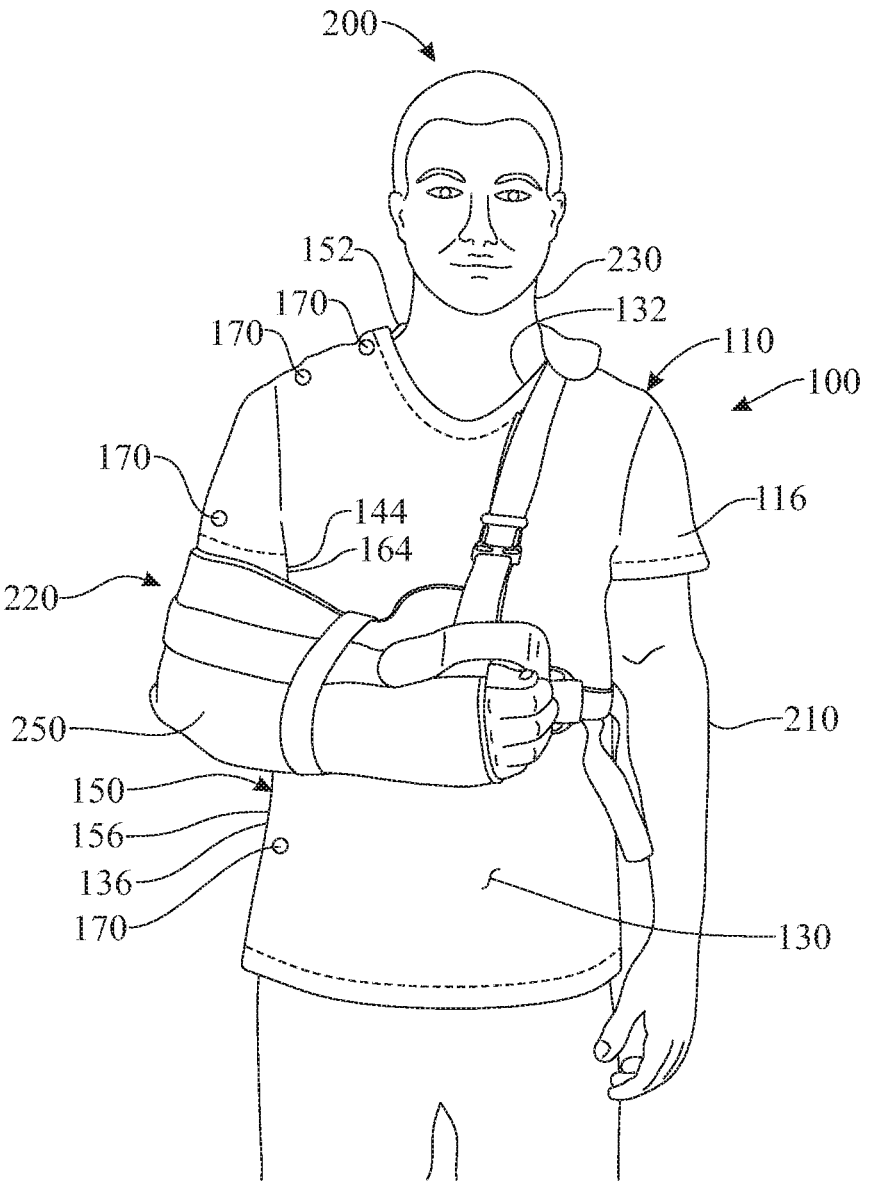
FIG. 9 presents a front view of the user with the garment assembly in the final donned configuration of FIG. 8, the user also wearing a sling on his right arm.

The garment assembly 100 of the present embodiment is particularly advantageous for wearing under a sling 250 as illustrated in FIG. 9. Once the garment assembly 100 is fitted onto the user, the user is able to comfortably wear the sling 250 over the garment assembly 100 regardless of whether the sling 250 supports the impaired second arm 220 in a therapeutic, slightly outward position, separated from the torso 240. The fact that there are no magnets in the underarm area, and optionally along the entire length of the front second sleeve inner edge 144 and rear second sleeve inner edge 164, minimizes or prevents any inward pulling of the second arm 220 by the sleeve-forming front and rear panels 130, 150. Thus, the garment assembly 100 does not counteract a corrective outward pulling force of the sling 250.

To remove the upper garment assembly 100, the user 200 merely needs to pull the front edges 134, 142 and 136 from the rear edges 154, 162 and 156 respectively until the various front magnets 170 disengage from the rear magnets 180. The user 200 can then lower his usable first arm 210 and allow the upper garment assembly 100 to slide off his first arm 210.

In some embodiments, the shirt can be interchangeably worn in the event of a mobility restriction on either one of the right arm and the left arm. For instance, the shirt can be worn reversed, so that the front panel 130 is arranged on the back and the rear panel 150 is arranged on the front, and the open second side of the garment body 110 is arranged on the user's left side instead of on the user's right side as shown in the drawings. Additionally or alternatively, it is contemplated that the garment body 110 can be reversed inside out, so that the inside is worn on the outside, and vice versa. When reversed front-to-back or inside out, the magnets 170, 180 are magnetically attached in pairs to maintain the front and rear panels 130, 150 affixed to one another, in a similar fashion as explained heretofore with reference to the drawings.

Since many modifications, variations, and changes in detail can be made to the described preferred embodiments of the invention, it is intended that all matters in the foregoing description and shown in the accompanying drawings be interpreted as illustrative and not in a limiting sense. Thus, the scope of the invention should be determined by the appended claims and their legal equivalents.

What is claimed is:

1. A method of donning an upper garment assembly by a human having a first arm and a second arm impaired with restricted mobility extending from a first shoulder and a second shoulder, respectively, comprising the steps of:

a) obtaining an upper garment assembly comprising:

a front panel configured to at least partially cover a front side of a human torso, the front panel having a first lateral side and a second lateral side respectively located at a first lateral side and a second lateral side of the garment assembly, the second lateral side of the front panel defining a front shoulder edge, a front neck edge, a front side edge, and a front second sleeve portion defining a front second sleeve outer edge, a front second sleeve inner edge, and a front second sleeve distal edge;

a rear panel configured to at least partially cover a rear side of the torso, the rear panel having a first lateral side and a second lateral side respectively located at the first lateral side and the second lateral side of the garment assembly, the second lateral side of the rear panel defining a rear shoulder edge, a rear neck edge, a rear side edge, and a rear second sleeve portion defining a rear second sleeve outer edge, a rear second sleeve inner edge, and a rear second sleeve distal edge, wherein each of the rear shoulder edge, the rear side edge and the rear second sleeve portion are initially fully detached from the corresponding front shoulder edge, front side edge and front second sleeve portion, respectively, and the rear neck edge is initially partially detached from the front neck edge to facilitate positioning the upper garment onto the torso;

the front panel is permanently joined to the rear panel along a shoulder seam proximate the first lateral side of the garment assembly, and the front panel is permanently joined to the rear panel along a side seam on the first lateral side of the garment assembly;

a first sleeve is disposed between the shoulder seam and the side seam and comprises a continuous tubular configuration having oppositely disposed open ends dimensioned to receive a portion of the user's first arm therethrough and to completely encircle a portion of the user's first arm therein;

a plurality of front magnetic fasteners affixed to the front panel along the front shoulder edge and the front side edge and the front second sleeve outer edge; and a plurality of rear magnetic fasteners affixed to the rear panel along the rear shoulder edge and the rear side edge and the rear second sleeve outer edge, each rear magnetic fastener in registration with a corresponding front magnetic fastener and configured to magnetically attract to the corresponding front magnetic fastener, wherein the front magnetic fastener affixed to the front second sleeve outer edge and the rear magnetic fastener affixed to the rear second sleeve outer edge magnetically attract to at least partially form a second sleeve therebetween;

b) inserting the first arm through the first sleeve;

c) raising the first arm;

d) allowing the first sleeve of the garment to slide down over a portion of the first arm;

e) using the first arm, grasping a top portion of the rear panel and bringing a top portion of the rear panel over the second shoulder;

f) using the first arm, securing the top portion of the rear panel over the second shoulder;

g) using the first arm, maneuvering a top portion of the front panel toward the top portion of the rear panel sufficiently to allow the front magnetic fasteners in the front shoulder edge to attract to and be pulled toward the rear magnetic fasteners in the rear shoulder edge and to bring the front panel towards the rear panel; and h) securing the front shoulder edge to the rear shoulder edge by a magnetic fastening of the front magnetic fasteners in the front shoulder edge to the rear magnetic fasteners in the rear shoulder edge, with the front neck edge and rear neck edge encircling a neck of the human; wherein steps b) through h) are carried out without using the second arm impaired with restricted mobility.

2. The method of claim 1, wherein the step of inserting the first arm through the first sleeve is carried out with the first arm held out.

3. The method of claim 2, wherein the step of inserting the first arm through the first sleeve is carried out with the first arm held out in a horizontal position.

4. The method of claim 1, wherein the step of allowing the garment to slide down over a portion of the first arm comprises grasping the garment in an area of the first sleeve with the hand of the first arm, raising the first arm and releasing the garment.

5. The method of claim 1, wherein the step of maneuvering the top portion of the front panel toward the top portion of the rear panel sufficiently to allow the front magnetic fasteners in the front shoulder edge to attract to and be pulled toward the rear magnetic fasteners in the rear shoulder edge comprises placing each front magnetic fastener at a distance less than or equal to 2 inches from the corresponding rear magnetic fastener.

6. The method of claim 1, wherein the step of securing the front shoulder edge to the rear shoulder edge is accompanied by an audible sound exerted by the magnetic fastening of the front magnetic fasteners in the front shoulder edge to the rear magnetic fasteners in the rear shoulder edge.

7. The method of claim 1, further comprising the steps of:

i) using the first arm, maneuvering the front side edge toward the rear side edge sufficiently to allow the front magnetic fasteners in t front side edge to attract to and be pulled toward the rear magnetic fasteners in the rear side edge and to bring the front side edge towards the rear side edge; and j) securing the front side edge to the rear side edge by a magnetic fastening of the front magnetic fasteners in the front side edge to the rear magnetic fasteners in the rear side edge; wherein steps i) and j) are carried out without using the second arm impaired with restricted mobility.

8. The method of claim 7, wherein the step of securing the front side edge to the rear side edge is accompanied by an audible sound exerted by the magnetic fastening of the front magnetic fasteners in the front side edge to the rear magnetic fasteners in the rear side edge.

9. The method of claim 1, wherein the front panel and the rear panel are unitary one with the other from a single piece of cloth.

10. The method of claim 1, further comprises the steps of:

k) using the first arm, maneuvering the front second sleeve outer edge toward the rear second sleeve outer edge sufficiently to allow the front magnetic fastener and rear magnetic fasteners thereon to pull the front second sleeve outer edge and the rear second sleeve outer edge towards one another; and l) securing the front second sleeve outer edge to the rear second sleeve outer edge by magnetic fastening of the front magnetic fasteners and rear magnetic fasteners thereon to one another, wherein steps l) and m) are carried out without using the second arm impaired with restricted mobility.

11. The method of claim 10, wherein the front second sleeve inner edge and t rear second sleeve inner edge are devoid of magnetic fasteners.

12. The method of claim 10, wherein an underarm area of the front and rear second sleeve portions is devoid of magnetic fasteners.

13. A method of donning an upper garment assembly by a human having a first arm and a second arm impaired with restricted mobility extending from a first shoulder and a second shoulder, respectively, comprising the steps of:

a) obtaining an upper garment assembly comprising:

a front panel configured to at least partially cover a front side of a human torso, the front panel having a first lateral side and a second lateral side respectively located at a first lateral side and a second lateral side of the garment assembly, the second lateral side of the front panel defining a front shoulder edge, a front neck edge, a front side edge, and a front second sleeve portion defining a front second sleeve outer edge, a front second sleeve inner edge, and a front second sleeve distal edge;

a rear panel configured to at least partially cover a rear side of the torso, the rear panel having a first lateral side and a second lateral side respectively located at the first lateral side and the second lateral side of the garment assembly, the second lateral side of the rear panel defining a rear shoulder edge, a rear neck edge, and a rear side edge, and a rear second sleeve portion defining a rear second sleeve outer edge, a rear second sleeve inner edge, and a rear second sleeve distal edge, wherein each of the rear shoulder edge, the rear side edge and the rear second sleeve portion are initially fully detached from the corresponding front shoulder edge, front side edge and front second sleeve portion, respectively, and the rear neck edge is initially partially detached from the front neck edge to facilitate positioning the upper garment onto the torso;

the front panel is permanently joined to the rear panel along a shoulder seam proximate the first lateral side of the garment assembly, and the front panel is permanently joined to the rear panel along a side seam on the first lateral side of the garment assembly;

a first sleeve is disposed between the shoulder seam and the side seam and comprises a continuous tubular configuration having oppositely disposed open ends dimensioned to receive a portion of the user's first arm therethrough and to completely encircle a portion of the user's first arm therein;

a plurality of front magnetic fasteners affixed to the front panel along the front shoulder edge and the front side edge and the front second sleeve outer edge; and a plurality of rear magnetic fasteners affixed to the rear panel along the rear shoulder edge and the rear side edge and the rear second sleeve outer edge, each rear magnetic fastener in registration with a corresponding front magnetic fastener and configured to magnetically attract to the corresponding front magnetic fastener, wherein the front magnetic fastener affixed to the front second sleeve outer edge and the rear magnetic fastener affixed to the rear second sleeve outer edge magnetically attract to at least partially form a second sleeve therebetween;

b) inserting the first arm through the first sleeve;

c) raising the first arm;

d) allowing the first sleeve of the garment to slide down the first arm;

e) using the first arm, grasping a top portion of the rear panel and bringing a top portion of the rear panel over the second shoulder;

f) using the first arm, securing the top portion of the rear panel over the second shoulder;

g) using the first arm, maneuvering a top portion of the front panel toward the top portion of the rear panel sufficiently to allow the front magnetic fasteners in the front shoulder edge to attract to and be pulled toward the rear magnetic fasteners in the rear shoulder edge and to bring the front panel towards the rear panel;

h) securing the front shoulder edge to the rear shoulder edge by a magnetic fastening of the front magnetic fasteners in the front shoulder edge to the rear magnetic fasteners in the rear shoulder edge, with the front neck edge and rear neck edge encircling a neck of the human;

i) using the first arm, maneuvering the front side edge toward the rear side edge sufficiently to allow the front magnetic fasteners in t front side edge to attract to and be pulled toward the rear magnetic fasteners in t rear side edge and to bring the front side edge towards the rear side edge; and j) securing the front side edge to the rear side edge by a magnetic fastening of the front magnetic fasteners in the front side edge to the rear magnetic fasteners in the rear side edge; wherein steps b) through j) are carried out without using the second arm.

14. The method of claim 13, wherein the step of inserting the first arm through the first sleeve is carried out with the first arm held out.

15. The method of claim 13, wherein the step of allowing the garment to slide down over the portion of the first arm comprises grasping the garment in an area of the first sleeve with the hand of the first arm, raising the first arm and releasing the garment.

16. The method of claim 13, wherein the step of maneuvering the top portion of the front panel toward the top portion of the rear panel sufficiently to allow the front magnetic fastener in the front shoulder edge to attract to and be pulled toward the rear magnetic fasteners in the rear shoulder edge comprises placing each front magnetic fastener at a distance less than or equal to 2 inches from the corresponding rear magnetic fastener.

17. The method of claim 13, wherein steps h) and j) are accompanied by audible sounds exerted by the magnetic fastenings.

18. A method of donning an upper garment assembly by a human having a first arm and a second arm impaired with restricted mobility extending from a first shoulder and a second shoulder, respectively, comprising the steps of:

a) obtaining an upper garment assembly comprising:

a front panel configured to at least partially cover a front side of a human torso, the front panel having a first lateral side and a second lateral side respectively located at a first lateral side and a second lateral side of the garment assembly, the second lateral side of the front panel defining a front shoulder edge, a front neck edge, a front side edge, and a front second sleeve portion defining a front second sleeve outer edge, a front second sleeve inner edge, and a front second sleeve distal edge;

a rear panel configured to at least partially cover a rear side of the torso, the rear panel having a first lateral side and a second lateral side respectively located at the first lateral side and the second lateral side of the garment assembly, the second lateral side of the rear panel defining a rear shoulder edge, a rear neck edge, and a rear side edge, and a rear second sleeve portion defining a rear second sleeve outer edge, a rear second sleeve inner edge, and a rear second sleeve distal edge, wherein each of the rear shoulder edge, the rear side edge and the rear second sleeve portion are initially fully detached from the corresponding front shoulder edge, front side edge and front second sleeve portion, respectively, and the rear neck edge is initially partially detached from the front neck edge to facilitate positioning the upper garment onto the torso;

the front panel is permanently joined to the rear panel along a shoulder seam proximate the first lateral side of the garment assembly, and the front panel is permanently joined to the rear panel along a side seam on the first lateral side of the garment assembly;

a first sleeve is disposed between the shoulder seam and the side seam and comprises a continuous tubular configuration having oppositely disposed open ends dimensioned to receive a portion of the user's first arm therethrough and to completely encircle a portion of the user's first arm therein;

a plurality of front magnetic fasteners affixed to the front panel along the front shoulder edge and the front side edge and the front second sleeve outer edge; and a plurality of rear magnetic fasteners affixed to the rear panel along the rear shoulder edge and the rear side edge and the rear second sleeve outer edge, each rear magnetic fastener in registration with a corresponding front magnetic fastener and configured to magnetically attract to the corresponding front magnetic fastener, wherein the front magnetic fastener affixed to the front second sleeve outer edge and the rear magnetic fastener affixed to the rear second sleeve outer edge magnetically attract to at least partially form a second sleeve therebetween;

b) inserting the first arm through the first sleeve with the first arm held out;

c) raising the first arm;

d) allowing the first sleeve of the garment to slide down over the portion of the first arm;

e) using the first arm, grasping a top portion of the rear panel and bringing a top portion of the rear panel over the second shoulder;

f) using the first arm, securing the top portion of the rear panel over the second shoulder;

g) using the first arm, maneuvering a top portion of the front panel toward the top portion of the rear panel sufficiently to allow the front magnetic fasteners in the front shoulder edge to attract to and be pulled toward the rear magnetic fasteners in the rear shoulder edge and to bring the front panel towards the rear panel;

h) securing the front shoulder edge to the rear shoulder edge by a magnetic fastening of the front magnetic fasteners in the front shoulder edge to the rear magnetic fasteners in the rear shoulder edge, with the front neck edge and rear neck edge encircling a neck of the human;

i) using the first arm, maneuvering the front side edge toward the rear side edge sufficiently to allow the front magnetic fasteners in the front side edge to attract to and be pulled toward the rear magnetic fasteners in the rear side edge and to bring the front side edge towards the rear side edge; and j) securing the front side edge to the rear side edge by a magnetic fastening of the front magnetic fasteners in the front side edge to the rear magnetic fasteners in the rear side edge;

k) using the first arm, maneuvering the front second sleeve outer edge toward the rear second sleeve outer edge sufficiently to allow the front magnetic fasteners and rear magnetic fasteners thereon to pull the front second sleeve outer edge and the rear second sleeve outer edge towards one another; and l) securing the front second sleeve outer edge to the rear second sleeve outer edge by magnetic fastening of the front magnetic fasteners and rear magnetic fasteners thereon to one another; wherein steps b) through l) are carried out without using the second arm impaired with restricted mobility.

19. The method of claim 18, wherein steps h) and j) are accompanied by audible sounds exerted by the magnetic fastenings.

* * * * *